United States Patent [19]

Simmons

[11] Patent Number: 4,962,921

[45] Date of Patent: Oct. 16, 1990

[54] INFLATABLE AQUATIC DEVICE

[76] Inventor: Thomas R. Simmons, 3510 Lobit, Dickinson, Tex. 77539-4310

[21] Appl. No.: 415,577

[22] Filed: Oct. 2, 1989

[51] Int. Cl.[5] ..... A63G 19/00

[52] U.S. Cl. ..... 272/1 B; 272/52; 272/56; 441/129

[58] Field of Search ..... 272/1 B, 52, 56; 441/40, 128, 129, 130, 35, 125, 126, 127

[56] References Cited

U.S. PATENT DOCUMENTS

| | | | |
|---|---|---|---|
| 2,404,729 | 7/1946 | Hurt | 272/1 B |
| 2,688,207 | 9/1954 | Hurt | 272/52 |
| 3,203,694 | 8/1965 | Kobashirawa | 272/1 B |
| 3,666,265 | 5/1972 | Ammerman et al. | 272/56 |
| 3,671,988 | 6/1972 | Newman | 272/1 B |
| 3,677,539 | 6/1972 | Bennent | 272/1 B |

*Primary Examiner*—Richard E. Chilcot, Jr.

[57] ABSTRACT

An inflatable device comprised of one or more inflatable chambers in a configuration suitable for supporting a person thereon. Remote control means 18,20 are included for accomplishing a cyclic inflation and deflation of at least one of the inflatable chambers in a manner to impart an oscillatory, vibratory or acceleratory motion to the device for the amusement of the person supported thereon or the controls operator.

13 Claims, 3 Drawing Sheets

INFLATABLE AQUATIC DEVICE

FIELD OF THE INVENTION

This invention relates to inflatable devices which are adapted to support a person thereon, and more particularly to inflatable aquatic flotation devices which can be remotely controlled for imparting pitching, vibratory or acceleratory motion thereto for recreational or therapeutic purposes.

BACKGROUND OF THE INVENTION

Inflatable devices for recreational uses which are adapted to support a person thereon have been devised in a variety of forms. Most generally, aside from propulsion of the device which can be achieved by motor means, motion of these devices can be achieved only by an action of the person supported thereon such as by paddling, leaning or jumping. Representative of related prior art devices is a pool toy described in U.S. Pat. No. 4,336,931 which comprises a buoyant body of substantially U-shaped outline having a relatively narrow center portion and bulbous end portions which can be ridden by a person seated astride its center portion. Although the rider can perform various maneuvers thereon, these generally must be initiated and controlled by the rider's own body movements.

SUMMARY OF THE INVENTION

The invention is an inflatable device adapted to support a person thereon which is useful particularly as an aquatic flotation device for recreation and amusement. The device comprises one or more inflatable chambers constructed of flexible pliant material, such as vinyl, and each chamber of which is provided with an opening and associated fitting adapted for connecting to the outlet hose of an air blower device. Interconnected with each chamber and the blower outlet hose is an alternating valve means for alternatively and repeatedly communicating each inflatable chamber with the blower outlet hose for receiving an inflating flow of pressurized air and then with an exhaust outlet of said valve means for inducing the deflation of the inflatable chamber. Control means, either manual controls or motor controls, are provided for controlling valve actuation and the cyclicality of alternation and time duration of the periods of inflation and deflation of each chamber whereby an oscillatory, vibratory or acceleratory motion can be imparted to the aquatic device for the amusement and recreation of a person supported on the aquatic device or a person in control of the valve operation. The inflatable device of the invention may be a single chambered device in the form of an oscillating air mattress or a device adapted for vertical oscillatory motion in the manner of a pogo stick. The invention may also comprise two or more inflatable chambers configured in such forms as a "bucking" horse, raft or vibrating pad wherein each chamber is alternately inflated and deflated by operation of the alternating valve means in synchronism such that inflation of one chamber is in coincidence with the deflation of the other to thereby impart an oscillatory pitching motion to the bucking horse or raft or a vibratory effect to the vibrating pad. Preferably, the blower and valve means are remotely located from the device and subject to the control of a person other than the person mounted on the device, particularly when employed as an aquatic device.

DETAILED DESCRIPTION OF THE INVENTION

Figure 1:
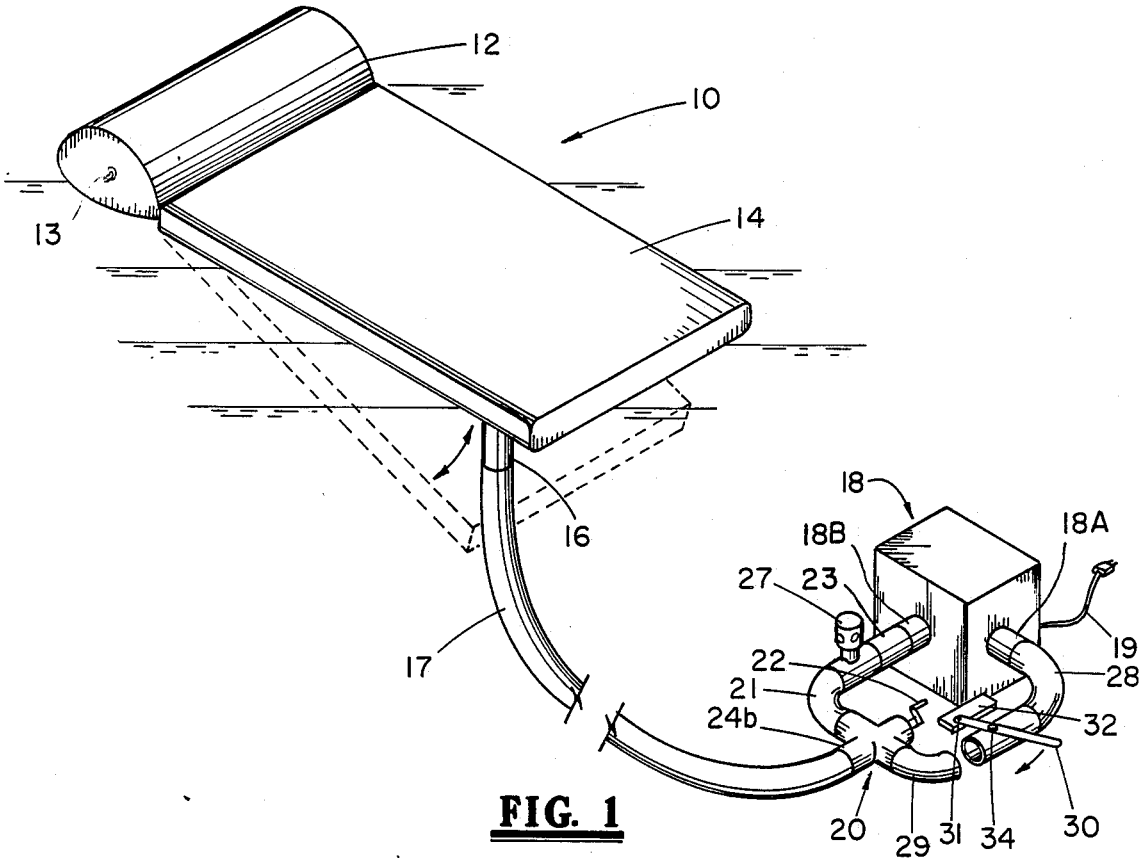
FIG. 1 is a perspective view of an embodiment of the invention which comprises a buoyant body in the form of an inflatable air mattress, a blower for supplying a flow of pressurized air and control means associated therewith for effecting the inflation and deflation of the mattress to impart a oscillatory motion thereto.

Referring more particularly to the drawings, there is shown in FIG. 1, an embodiment of the invention 10 which comprises a buoyant body in the form of an inflatable air mattress 14 which is constructed of a light weight flexible sheet material, such as vinyl or the like. The air mattress 14 is provided at one end with a head-rest portion 12 which is attached thereto by a suitable adhesive, heat fusion or the like. The head-rest 12 is preferably an inflated chamber provided at one end with a valve 13 of a known type for inflation purposes, although the head-rest 12 could be manufactured from such substances as foam rubber or a resilient plastic.

On its underside the air mattress 14 is provided with an air intake port having a fitting 16 affixed thereto for accommodating connection to a flexible hose 17. The hose 17 is adapted to convey a flow of pressurized air to the inflatable mattress 14. For this purpose an electrically operated blower device 18 is provided. The blower 18 is preferably a commercially available type having an electric cord 19 for connecting to an electrical power supply and provided with suction inlet 18A and hose 28 connected thereto and an outlet 18B with an outlet hose 23 connecting therewith. A pressure relief valve 27 is installed in the hose conduit 21 which connects to the outlet hose 23 and to the inlet port of a rotary valve 20. The valve 20 includes an outlet **24*b* to which one end of the flexible hose 17 is connected and an exhaust outlet 23*b*. By operation of the valve 20 through rotation of its valve element 35 shown in FIG. 2, as will hereinafter be described, a flow of air at constant pressure may be delivered to the inflatable air mattress in a first operative position of the valve element whereby the air mattress is placed in an inflated state. In a second operative position of the valve element, fluid communication between the blower 18 and the inflatable air mattress 14 is blocked while fluid communication between the air mattress and the exhaust outlet 23*b* is established so that the mattress begins to deflate because of its pressurized condition and the weight of a person in reclined position on the mattress. When the valve element 35 is moved in rapid alternation between its first and second operative positions, as by rotation of a handle 22, the alternating cyclical inflation and deflation of the mattress 14 can be accomplished to impart an oscillating movement of the mattress which is pivotal about its floating head-rest 12. Obviously, the period of oscillation is determined by the time interval between the inflated and deflated states of the mattress, which is in turn controlled by the rate of movement of the valve element between its first and second operative positions. In addition, the intake port and fitting 16 for the inflatable mattress are of an unconventional large size to insure there will be rapid flow of air into and out of the mattress. The hose 17** is also an accommodatingly large and very flexible type such as is used in commercial vacuum cleaners.

In some instances, where it may be necessary to speed the rate of deflation, the suction inlet hose 28 of the blower 18 can be connected in fluid communication with the valve exhaust outlet **23*b* by connecting to one end of an exhaust hose 29 which connects with the exhaust outlet 23*b* whereupon the intake of the blower effects a suction which more rapidly deflates the air mattress when the valve 20 is positioned to the exhaust condition. For expeditiously accomplishing this connection, a lever arm 30 is provided which connects at one end by a pivot connection 31 to an extension 32 of the blower housing and by a second pivot connection 34 to one end of the suction hose 28. The dimension and arrangement of the lever arm 30** is such that it may be quickly pivoted to connect the blower suction hose to the valve exhaust outlet.

Figure 2:
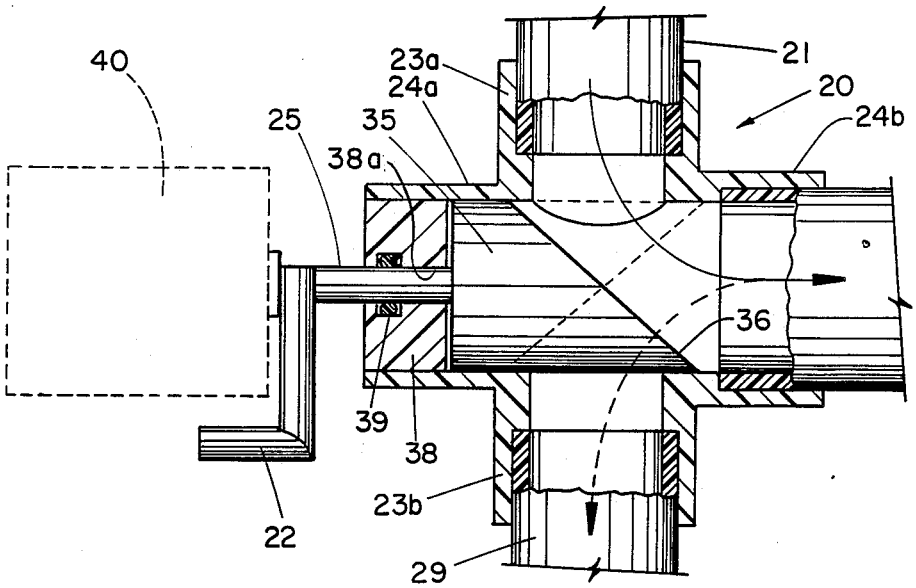
FIG. 2 is a view, partly in section, of a valve which is used to alternately connect an inflatable chamber of the invention with a source of pressurized air and then with an exhaust port for effecting alternating cyclic inflation and deflation of the chamber.

With reference to FIG. 2, the valve 20 is shown, partly in section, to comprise a four-way tubular body formed with two cylindrical bores which extend therethrough at right angles and provide the valve body with an intake port **23*a*, an outlet port 24*b* and an exhaust port 23*b*. The intake port 23*a* is adapted to receive a flow of pressurized air from the blower 18 by means of the conduit 21 which is connected thereto. The outlet port 24*b* is fitted to the hose 17 which connects thereto at one end and at its other end to an inflatable chamber such as the air mattress 14**.

The exhaust port **23*b* of the valve body is in alignment with the intake port 23*a* which is formed as an extension of the same cylindrical bore which forms the exhaust port. The valve body also includes a tubular extension 24*a* which is formed in alignment with the outlet port 24*b* and is closed by an annular plug 38. The valve element 35 is a cylindrical body which is provided with a slant face 36 at one end. The valve element 35 is adapted for axial rotation in the valve body 20*a* and is seated in coaxial alignment with the bores which form the tubular extension 24*a* and the outlet 24*b***.

The valve element 35 is provided with a valve stem 25 which extends through the central opening **38*a* of a plug member 38 in sealing relation therewith by means of an O-ring seal 39 seated in an annular groove in the wall of the central opening 38*a*. A crank handle 22 is provided for the valve stem 25 as a radial extension thereof, whereby the valve stem and valve element 35 may be axially rotated. The valve element 35 as shown in FIG. 2, blocks communication between the intake port 23*a* and exhaust outlet 23*b*. However, it is provided with the slant face 36 such that, in the position shown in FIG. 2, fluid communication is established between the intake and outlet ports 23*a* and 24*b* and a continuous pressurized flow of air is delivered from the blower 18 to the mattress 14 to maintain the mattress or float 14 in fully inflated condition. It will also be apparent from FIG. 2, that the valve element 35 when rotated 180° to the position shown in dashed lines will completely block the flow of air from the blower 18 to the conduit 17 such that the supply of the pressurized air to the float 14 is terminated. However, when in this position, fluid communication is open between the flexible conduits 17 and 29 connecting with the outlet and exhaust ports, respectively, such that air from the float 14 can be released and exhausted through the conduit 29. Obviously, as the valve element 35 is rotated to move between these two positions, the flow of pressurized air from the blower 18 to the air mattress 14 or other chamber to be inflated will decline from a maximum flow to a zero flow condition whereupon there commences an outflow of air from the air mattress 14 or other inflatable chamber connected to the valve. With continued rotation of the valve element, communication of the conduit 17 with the exhaust port 23*b* will gradually close until communication with the conduit 21 and blower outlet is fully established. It is to be seen therefore that continual rotation of the valve element 35 produces the effect of inflating and deflating the air mattress 14 or other inflatable chamber in repeated cyclical alternation. The time period between inflation and deflation can be readily controlled by manually turning the handle 22 at a controlled rate. If desired an automatic means for valve rotation may be provided by a motor 40 operably coupled to the valve stem 25 or handle 22** for effecting its rotation.

Since it would be awkward for the person riding the air mattress or float 14 to control its oscillatory movement, and for safety reasons, the valve 20 and blower 18 are placed at a remote location such as the poolside or on the beach for operation by another person. It is also likely to be more fun to the rider if he remains more apprehensive as to what is going to happen next. Further, it is possible that water could enter the interior of the float during the deflation period if the exhaust to atmosphere opening were on board the float.

In FIG. 3, there is shown a second embodiment of the invention, wherein the invention comprises an inflatable flotation chamber in the form of an annular tube 45 having an opening in the wall with a fitting 47 to which a conduit, such as the conduit 17, may be readily connected. Within the open area encircled by the tube 45, is provided a lattice-type platform or grating 49 constructed of plastic or other light weight material which is secured to the tube 45 in suitable fashion as by heat welding or straps (not shown). The platform 49 is provided with a central opening and is disposed in a sleeved relationship about a vertical pole 42 of aluminum or the like which extends through the central opening of the platform 49. The pole 42 is provided at one end with an anchor weight 44 which is adapted to rest on the bottom of a pool and maintain the pole in an upright position.

It is to be understood that the tube 45 is to be connected to a blower and control valve such as the blower 18 and valve 20 shown in FIG. 1. Because of the lattice-like construction of the platform 49 and the numerous openings provided therein, the platform 49 is adapted to move easily through the water with little resistance. Accordingly, a person 50 may stand on the platform 49 and as pressurized air is delivered to the tube 45 from a source of pressurized air such as the blower 18, the sudden inflation of the tube 45 from a deflated condition will cause the tube 45 to rise rapidly and catapult the person upwardly as shown by the arrow in FIG. 3A. However, when the pressurized flow of air to the tube 45 is cut off, the tube 45 will commence to deflate and sink in reverse direction as shown in FIG. 3B. Since the tube 45 is constrained to move in the axial direction of the pole 42 about which it is centered, the pole should be of sufficient length that the tube 45 remains sleeved about the pole throughout the extent of its up-and-down motion, and particularly so for the safety of the rider on the platform.

Figure 3A:
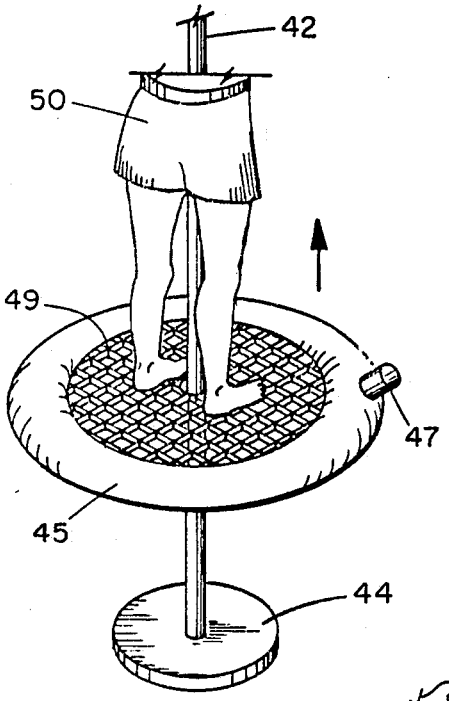
FIGS. 3A and 3B are fragmentary views of a second embodiment of the invention which comprises an annular flotation tube having a perforate platform in the central area of the tube and provided with a central opening for accommodating an upright anchored pole member extending therethrough in a slidable relationship whereby sudden upward and downward motions may be imparted to the tube as shown in FIGS. 3A and 3B, respectively, when connected to a blower and control means as shown in FIG. 1.
Figure 3B:
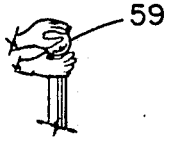
Figure 3B:
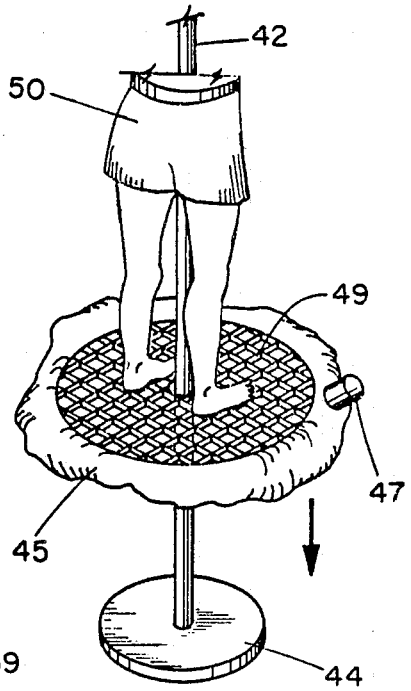
Figure 3C:
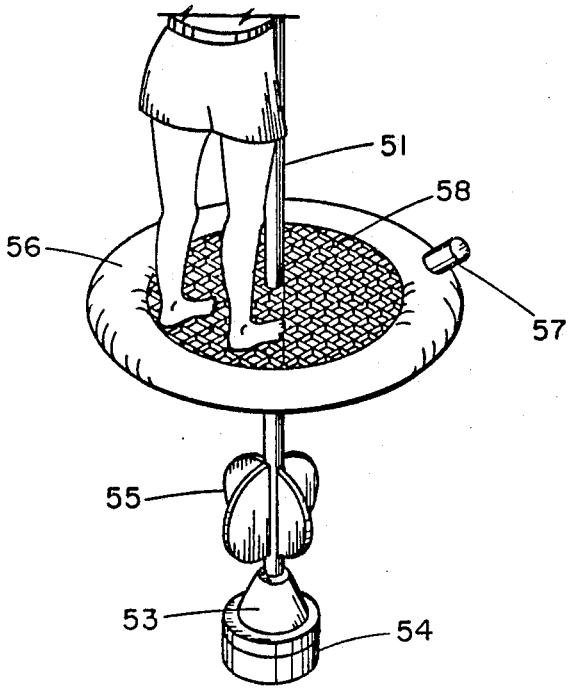
FIG. 3C is a fragmentary view of another embodiment of the invention, similar to the embodiment shown in FIG. 3A but wherein the platform is rigidly attached to the pole member whereby the platform and pole member are adapted to move in the manner of a pogo stick when connected to a means for alternate cyclical inflation and deflation of the flotation tube.

A modified form of the invention similar to the apparatus shown in FIG. 3A is shown in FIG. 3C. The apparatus in FIG. 3C is identical to the apparatus of FIG. 3A except that the platform 58 in the center of the tube 56 is fixed to the vertical pole 51 such as by an attaching collar or the like (not shown). The pole 51 is similar to the pole 42, but is preferably provided with a spherical ball or knob 59 at its upper end which can be grasped by the hands of a person standing erect on the platform 58. At its lower end of the pole 51 is provided with an anchor weight 53 to which a pad 54 of foam rubber or other resilient customary material is affixed to serve as a pad or shock absorbing device. A blower 18 with control valve 20 and hose 17 as shown in FIG. 1, are connectable to the inlet 57 and are operable as previously described. In operation, therefore, the intermittent flow pressurized air from the blower 18 to the tube 56 through its inlet 57 as controlled by the valve 20 will cause the cyclic inflation and deflation of the tube 56 and a consequent up and down motion of the entire apparatus in the manner of a pogo stick whereby a rider can bounce up and down from the bottom of the pool. For purposes of stability, the pole 51 is provided with a plurality of fins 55 at a location between the platform 58 and the anchor weight 53.

Figure 4A:
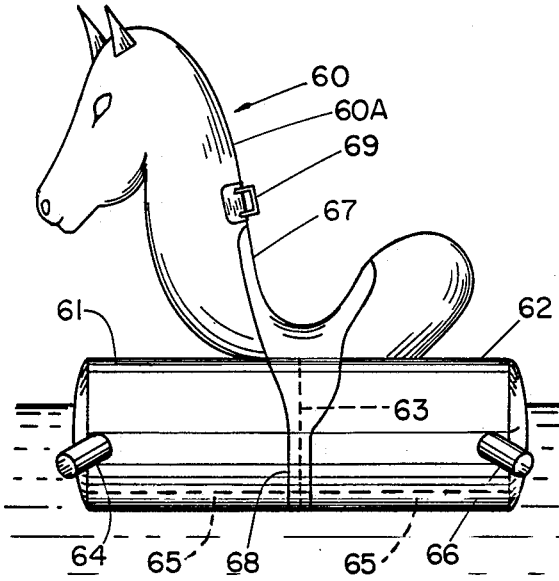
FIGS. 4A and 4B are views of another embodiment of the invention comprised of two inflatable chambers forming the fore and aft portions of an elongate buoyant body with a saddle attached thereto, and each of said chambers is provided with an inlet for connection with a blower outlet hose whereby each of said chambers may be subjected to alternating cyclical inflation and deflation in synchronism when connected to the inflation control means of the invention.
Figure 4B:
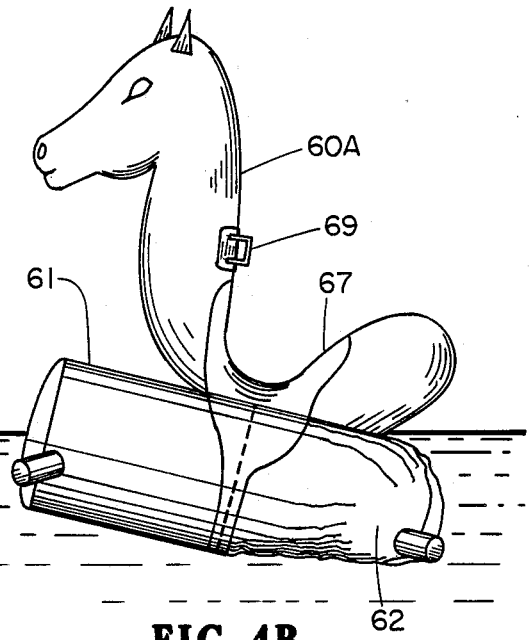

In FIGS. 4A and 4B there is shown a further embodiment of the invention designed primarily for use as a pool toy 60. The pool toy 60 comprises a buoyant body formed by two inflatable chambers 61,62 fabricated of a conventional flexible liquid impervious material, each in the general form of an elongate cylinder and being separately inflatable. The two cylindrical chambers 61,62 are joined together in substantially coaxial alignment at adjacent ends along a seam or junction line 63 in any suitable manner which preserves their structural integrity and separate inflatability. The chamber 61 is provided with an inlet fitting 64 to which an air supply hose such as the hose 17 of FIG. 1 can be connected. In similar fashion, the chamber 62 is provided with an inlet fitting 66. Each chamber 61,62 is connectable to a blower and control valve such as the blower 18 and control valve 20 of FIG. 1. Also, a ballast means 65, which in an appropriate form may be sand, is placed in each chamber 61, 62 in loose form or sandbags to settle on the chamber bottom or to be fixed thereon so as to maintain its orientation when the toy 60 is placed in a pool of water.

The buoyant body formed by the chambers 61,62 when inflated is provided with a saddle 67 which is strapped or otherwise attached thereto substantially amidships at the junction 63. The saddle 67 may be attached directly to the chambers 61,62 or it may encompass an upper body attachment 60A to the chambers 61,62 having a general U-shape configuration. The attachment 60A has a relatively narrow central portion which accommodates the saddle 67 and larger bulbous end portions configured in the form of the fore and aft portions of a horse. A handle 69 is affixed to the neck of the horse for the convenience of a rider seated on the saddle 67 astride the buoyant body provided by the chambers 61,62. The upper attachment 60A may itself be an inflatable chamber of flexible material or it could be constructed of a rigid light weight material.

It is to be seen, therefore, that a person operating a pair of control valves 20 operatively connected to each of the chambers 61,62 may effect their alternate inflation and deflation in a manner to effect a "bucking" action of the pool toy or horse 60A to his own amusement and that of the rider. Obviously for best effects, inflation and deflation of the chambers 61,62 should be operated in sequence such that as one inflates the other deflates. It is possible, of course, to provide a programmed control to vary the cycliability of inflation and deflation for each chamber 61,62 to enhance the "bucking" action.

Figure 5:
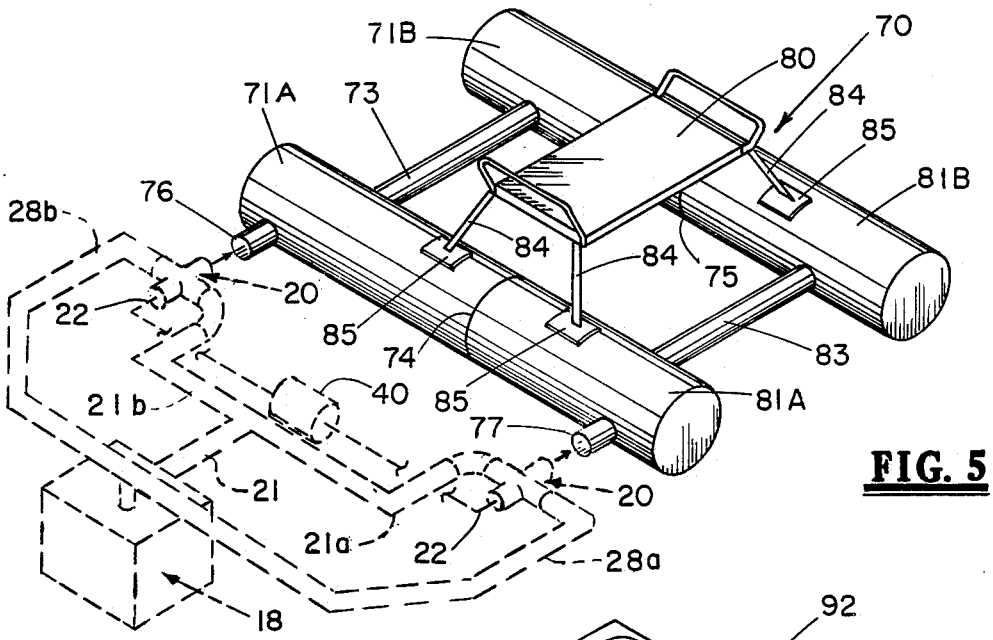
FIG. 5 is a perspective view of a further embodiment of the invention comprised of two inflatable chambers which form the fore and aft portions of each of the hulls of a twin-hulled raft.

A further embodiment of the invention in the form of a twin-hulled raft 70 is disclosed in FIG. 5. The twin hulls of the raft are formed by joined inflatable chambers in which the forward portions 71A,71B of each hull from the centerline 74 forward joined by a transverse conduit 73 form one inflatable chamber. In similar fashion, the aft portions 81A,81B of each hull joined by a transverse conduit 83 form a second inflatable chamber. The forward hull inflatable chamber is provided with an inlet fitting 76 and the aft hull inflatable chamber is provided with an inlet fitting 77. Each fitting 76,77 is designed for connection with a flexible conduit which communicates with a control valve and blower such as the conduit 17, valve 20 and blower 18 of FIG. 1.

The raft 70 is also provided with a bench 80 which is provided with four rigid legs 84, each of which is provided with a foot 85. The bench 80 straddles the twin hulls of the raft 70 with its four feet attached to the chambers' sections 71A,72B,81A,82B. A person may therefore be seated on the bench 80 with his feet dangling between the twin hulls of the raft are placed on either one of the cross tubes 73,83. As in other embodiments of the invention, the inflatable chambers of the raft are fabricated from flexible pliant material.

By operation of a pair of control valves 20, each operatively connected to a different one of the fore and aft inflatable chambers of the raft 70, an operator manually turning the handles of the valves can effect the alternate inflation and deflation of the chambers in a manner to impart a pitching motion to the raft so long as the inflation of one chamber is synchronized in coincidence with the deflation of the other.

An assembly of control valves 20 connected to a single blower 18 is shown in dashed lines in FIG. 5 whereby synchronism of inflation and deflation of the respective inflatable chambers of the raft may be easily obtained. A single motor 40 is operatively connected to the handles 22 of the valves 20 to effect simultaneous rotation of respective valve elements 35 of the two valves. The outlet conduit 21 of the blower 18 is connected by branches **21*a* and 21*b* to the intake ports of each valve 20. The suction inlet of the blower 18 is connected to the exhaust outlets of the respective valves by branch conduits 28*a*,28*b* for expediting the deflation times for each of the chambers. The suction conduits 28*a*,28*b* may, of course, be omitted if it is desired to exhaust the chambers to atmosphere. In the initial coupling of the motor 40 to the valves 20, it is important that the valve element of one valve 20 be positioned to admit pressurized air to its associated inflatable chamber and the valve element of the other valve 20 be positioned to exhaust the air from the other chamber. These positions, of course, will reverse repeatedly as the motor rotates the handles 22**.

Figure 6:
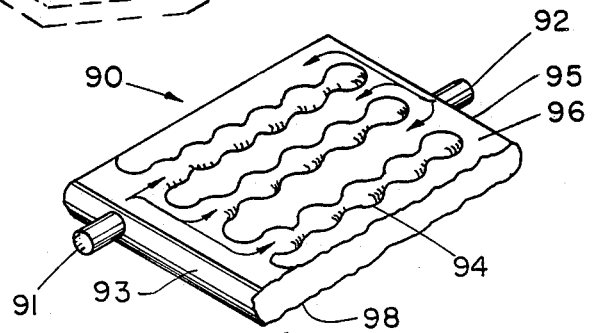
FIG. 6 is a perspective view of another embodiment of the invention in the form of an air mattress where two separately inflatable air chambers are formed by the joining of the upper and lower surfaces of the mattress along a sinuous line whereby each chamber comprises finger-like branches in interleaved alternate array with the branches of the other whereby a vibratory motion may be imparted to the mattress by connecting the inlets of each chamber with an inflation control means of the invention.

A still further embodiment of the invention in the form of a vibrator mat 90 is shown in FIG. 6. The mat 90 is fabricated from flexible fluid impervious sheet material with top and bottom walls 96,98 and end walls 93,95. An inlet fitting 91 is installed in the end wall 93 and a similar inlet fitting 92 is installed in the end wall 95. The top and bottom walls 96,98 are joined along their planar surfaces by a seam 94 which runs back and forth in continuous fashion in both the lengthwise and transverse directions so as to divide the mat 90 into two separately inflatable chambers, each of which is adapted for inflation through a different one of the inlet fittings 91,92. The seam 94 is arranged so that each inflatable chamber comprises a plurality of finger-like tubular branches which interleave in alternation with the finger-like tubular branches of the other chamber. Preferably, the seam 94 is of sinuous configuration rather than linear, whereby the mat is provided with a modular surface when either of the chambers is inflated.

By connecting the inlet fittings 91,92 to a source of controlled air pressure such as by means of the conduit 17, valve 20 and blower 18 of FIG. 1, each of the inflatable chambers may be cyclically inflated and deflated to provide a vibrating surface for the comfort or amusement of a person reclining on the mat 90. To insure synchronism and the coincident inflation of one chamber with deflation of the other an assembly of valves 20 connected to a single motor for valve operation as shown in FIG. 5 might also be employed.

It is also to be understood that the pair of valves 20 controlled by a single motor 40 as shown in FIG. 5 might also be employed for operation of the pool toy shown in FIGS. 4A and 4B.

It is therefore to be seen that a novel device is disclosed herein which comprises an inflatable body in a variety of forms configured to support a person thereon. The inflatable body may be subjected to a controlled inflation and deflation in cyclic alternation in a manner to impart an oscillatory, vibratory or acceleratory motion thereto. The inflatable body of the device is provided with a constant source of inflation and means of deflation including a control means for achieving a continuously variable buoyancy for the entertainment and amusement of a person supported. Besides swimming pools and other bodies of water, the novel inflatable device of the invention can also be used in playground areas, exercise rooms, and the like.

It is also to be understood that the foregoing description of the invention has been presented for purposes of illustration and explanation and is not intended to limit the invention to the precise forms disclosed. For example, each of the inflatable chambers of the various forms of the invention might be provided with a pair of inlets for air intake and exhaust, respectively, rather than a single inlet for both functions as described herein. A valve different from the valve 20 might then be employed in each of the conduits connecting to the pair of inlets for control of intake and exhaust. It is to be appreciated therefore, that various changes in the invention may be made by those skilled in the art without departing from the invention.

I claim:

1. An inflatable device configured to support a person thereon, said device comprising one or more inflatable chambers constructed of flexible pliant material, and control means for controlling the inflation of at least one of said inflatable chambers by effecting the inflation and deflation of said chamber in rapid cyclical alternation whereby the cyclical inflation and deflation of said chamber imparts an oscillatory or acceleratory motion to said device.

2. An inflatable device as set forth in claim 1 wherein said device comprises an inflatable chamber in the form of a mattress having a separate buoyant head-rest portion affixed thereto at one end whereby said inflatable mattress when disposed for flotation in a body of water is adapted to move in an oscillatory pivotal motion about said head-rest portion when subjected to rapid cyclical inflation and deflation by said control means.

3. An inflatable device as set forth in claim 2 wherein said device comprises a source of constant air pressure, conduit means comprising a conduit interconnecting said pressure source with said one inflatable chamber whereby a flow of pressurized air is delivered to the interior thereof, alternating valve means installed in said conduit and comprising a valve body having an inlet port, an outlet port and an exhaust port, a valve element rotatably mounted in said valve body for rotating movement between a first position where said source of air pressure is connected in fluid communication through said inlet and outlet ports with said inflatable chamber for inflation of said chamber and a second position wherein said source of air pressure is blocked from communication with said chamber and said chamber is connected in fluid communication with said exhaust port for effecting the deflation thereof, and actuator means for moving said valve element to said first and second positions in repeated cyclical alternation for effecting the inflation and deflation of said one inflatable chamber in alternation and for imparting an oscillatory motion thereto.

4. An inflatable device as set forth in claim 3 wherein said source of constant air pressure, said alternating valve means and said actuator means are located remote from said buoyant body.

5. An aquatic device comprising an inflatable buoyant body of annular configuration;

control means for remotely controlling the buoyancy of said inflatable buoyant body by effecting the inflation and deflation thereof in rapid cyclical alternation, said control means being remotely located from said buoyant body, a perforate platform disposed in the center area of the inflatable body and attached thereto in substantially concentric co-planar relationship, said annular inflatable body and platform being of a size sufficient to accommodate and support a person standing thereon, said platform having an opening located substantially at the center thereof, an elongate pole member extending through said central opening in a relatively loose slidable relationship with said platform, a weight member attached at one end of said pole member such that said aquatic device is adapted to be disposed in a pool of water with said weight member anchoring said device to the floor of the pool and maintaining said pole member in upright position whereby an oscillatory up-and-down motion may be imparted to said platform and person supported thereon by the inflation and deflation of said inflatable body in rapid cyclical alternation as controlled by said control means.

6. An aquatic device as set forth in claim 5 wherein said pole member is fixedly attached to said platform and said weight member is of sufficiently small weight that said pole member moves in concert with said platform when an oscillatory up-and-down motion is imparted thereto by operation of said control means.

7. An aquatic device as set forth in claim 6 wherein said pole member is provided with a plurality of fin members attached thereon at a location below the attachment of said platform to the pole member for maintaining said device in substantially upright orientation as it moves in oscillatory up-and-down motion.

8. An inflatable device configured to support a person thereon, said device comprising a pair of inflatable chambers, each constructed of flexible pliant material, blower means for supplying a pressurized flow of air to the interior each of said chambers, and control means operably coupled to said blower means for controlling the inflation of each of said chambers by effecting the inflation and deflation of each said chamber in rapid cyclical alternation and wherein the inflation and deflation of said chambers is synchronized so that when one of said chambers is inflated the other of said chambers is deflated to thereby impart an oscillatory or vibrating motion to said device.

9. An inflatable device as set forth in claim 8 wherein said inflatable device is in the form of an air mattress having upper and lower surfaces of flexible pliant sheet material and said inflatable chambers are formed by the joining of said upper and lower surfaces along a sinuous line such that each said chambers comprises a series of elongate finger-like branches and the branches of one said chamber are interleaved in alternate array with the branches of the other of said chambers.

10. An inflatable device as set forth in claim 8 wherein said inflatable device comprises a buoyant body configured in the form of a twin-hulled raft and one of said inflatable chambers forms the forward portions of each of said hulls and the other of said inflatable chambers forms the aft portions of each of said hulls, said forward hull portions being in fluid communication and said aft hull portions being in fluid communication, and a person-supporting seat structure interconnecting the twin hulls substantially amidships such that the raft may be imparted with an oscillatory pitching motion in the fore and aft direction by operation of said control means, said control means being remotely located with respect to said buoyant body for effecting the remote control thereof.

11. An inflatable device as set forth in claim 10 wherein the forward portions of each of said hulls are joined in fluid communication by a first inflatable tubular member extending transversely therebetween and said aft portions of each of said hulls are joined by a second inflatable tubular member extending transversely therebetween.

12. An inflatable device as set forth in claim 8 wherein said inflatable device is configured in the form of an elongate buoyant body and said inflatable chambers are joined in alignment to form the fore and aft portions of said elongate buoyant body, and a saddle attached to said elongate buoyant body at a location intermediate its ends and substantially at the junction of the fore and aft chambers for accommodating a person seated astride said buoyant body whereby a pitching or bucking motion may be imparted to said elongate buoyant body in the fore and aft direction by operation of said control means, said control means being remotely located with respect to said buoyant body for effecting the remote control thereof.

13. An inflatable device as set forth in claim 12 further including a separate upper body of general U-shape configuration attached to said elongate body, said upper body having a center part defining a seat for accommodating a saddle for a person to sit astride said buoyant body, said upper body having end parts of larger size than said center part for defining head and tail end portions thereof.

* * * * *